US010465641B1

(12) United States Patent
Ochiai et al.

(10) Patent No.: US 10,465,641 B1
(45) Date of Patent: Nov. 5, 2019

(54) OUTBOARD MOTOR AND WATERCRAFT

(71) Applicant: YAMAHA HATSUDOKI KABUSHIKI KAISHA, Iwata-shi, Shizuoka (JP)

(72) Inventors: Katsumi Ochiai, Shizuoka (JP); Tomoaki Sato, Shizuoka (JP); Yasutaka Itou, Shizuoka (JP); Yuta Miyagi, Shizuoka (JP); Takayuki Yamada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 884 days.

(21) Appl. No.: 14/855,563

(22) Filed: Sep. 16, 2015

(51) Int. Cl.
*B63H 20/32* (2006.01)
*F02M 35/16* (2006.01)

(52) U.S. Cl.
CPC ..... *F02M 35/168* (2013.01); *B63H 20/32* (2013.01)

(58) Field of Classification Search
CPC ..... B63H 20/32; F02M 35/168
USPC ..... 440/77, 88 A
See application file for complete search history.

(56) References Cited

U.S. PATENT DOCUMENTS 5,340,343 A * 8/1994 Kawamukai ..... F02B 61/045 440/77
5,445,547 A * 8/1995 Furukawa ..... F02B 61/045 440/77
5,573,436 A * 11/1996 Trudeau ..... F02M 35/10013 440/77
6,899,579 B1 * 5/2005 Bruestle ..... B63H 20/002 440/77
7,118,432 B2 * 10/2006 Katayama ..... B63H 20/32 440/77
7,247,065 B2 * 7/2007 Ito ..... B63H 20/32 440/77
7,299,783 B1 * 11/2007 Broman ..... F01P 7/08 123/198 E
7,438,614 B2 * 10/2008 Inaba ..... B63H 20/00 440/77
7,517,265 B2 * 4/2009 Takahashi ..... F02M 35/09 440/77
8,870,613 B2 * 10/2014 Watanabe ..... F02M 35/088 440/88 A
8,894,455 B2 * 11/2014 Watanabe ..... B63H 20/32 440/77

(Continued)

FOREIGN PATENT DOCUMENTS

JP 2008-088881 A 4/2008

*Primary Examiner* — S. Joseph Morano
*Assistant Examiner* — Jovon E Hayes
(74) *Attorney, Agent, or Firm* — Keating and Bennett, LLP

(57) ABSTRACT

An outboard motor includes an engine, an engine cover accommodating the engine, and an intake path between the engine cover and the engine. The intake path directs external air to the engine. The engine cover includes an upper cover and a lower cover. The upper cover includes an opening to take external air into the intake path. The intake path includes a first airflow passage, a second airflow passage, and an airflow space. The first airflow passage is at least partially defined by an inner surface of the engine cover, and downwardly directs the external air. The second airflow passage is at least partially defined by the inner surface of the engine cover, and upwardly directs the external air. The airflow space is above the lower cover and continues to the first airflow passage and the second airflow passage.

16 Claims, 15 Drawing Sheets

(56) References Cited

U.S. PATENT DOCUMENTS

| | | | | |
|---|---|---|---|---|
| 9,359,981 | B1 * | 6/2016 | Waisanen | F02M 35/167 |
| 10,220,927 | B2 * | 3/2019 | Bruestle | F04D 25/02 |
| 2003/0013360 | A1 * | 1/2003 | Isogawa | F02B 61/045 440/77 |
| 2004/0229528 | A1 * | 11/2004 | Yazaki | B63H 20/00 440/88 A |
| 2007/0054569 | A1 * | 3/2007 | Murai | B63H 20/32 440/77 |
| 2007/0266988 | A1 * | 11/2007 | Ishizaka | F02M 35/10013 123/198 E |
| 2008/0081523 | A1 * | 4/2008 | Ide | F02M 35/10111 440/88 A |
| 2012/0214367 | A1 * | 8/2012 | Watanabe | B63H 20/32 440/77 |

* cited by examiner

OUTBOARD MOTOR AND WATERCRAFT

BACKGROUND OF THE INVENTION

1. Field of the Invention

The present invention relates to an outboard motor including an intake path to direct external air to an engine, and to a watercraft including the outboard motor.

2. Description of the Related Art

A well-known method, which has been conventionally applied to an outboard motor equipped with an engine and an engine cover that accommodates the engine, includes providing an intake duct to direct external air to the engine in a gap between the engine and the engine cover (see Japan Laid-open Patent Application Publication No. 2008-88881).

However, in the method disclosed in Japan Laid-open Patent Application Publication No. 2008-88881, when the engine cover is designed to have a size equivalent to a type of engine cover designed to contain no intake duct in the gap between the engine and the engine cover, the intake duct must be disposed in a narrow gap, and hence, the area of the intake duct cannot be enlarged. Therefore, it is difficult to inhibit the flow rate of the external air flowing through the intake duct. Consequently, the efficiency of removing water drops contained in the external air is degraded.

SUMMARY OF THE INVENTION

Preferred embodiments of the present invention provide an outboard motor that enhances the efficiency of removing water drops contained in the external air, and a watercraft including the outboard motor.

An outboard motor according to a preferred embodiment of the present invention includes an engine, an engine cover accommodating the engine, and an intake path between the engine cover and the engine. The intake path is configured to direct external air to the engine. The engine cover includes an upper cover and a lower cover. The upper cover covers the engine from above and lateral sides of the engine. The lower cover covers the engine from below. The upper cover includes an opening configured to take the external air into the intake path. The opening is preferably provided in an upper portion of the upper cover. The intake path includes a first airflow passage, a second airflow passage, and an airflow space. The first airflow passage is at least partially defined by an inner surface of the engine cover. The first airflow passage is configured to downwardly direct the external air taken in through the opening. The second airflow passage is at least partially defined by the inner surface of the engine cover. The second airflow passage is configured to upwardly direct the external air. The airflow space is provided above the lower cover and extends to the first airflow passage and the second airflow passage. The airflow space is configured to direct the external air from the first airflow passage to the second airflow passage.

According to the preferred embodiments of the present invention disclosed herein, it is possible to provide an outboard motor that enhances the efficiency of removing water drops contained in the external air, and a watercraft including the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will now be explained with reference to the drawings. It will be apparent to those skilled in the art from this disclosure that the following descriptions of the preferred embodiments are provided for illustration only and not for the purpose of limiting the present invention as defined by the appended claims and their equivalents.

Preferred embodiments will be hereinafter explained with reference to the attached drawings.

First Preferred Embodiment

Figure 1:
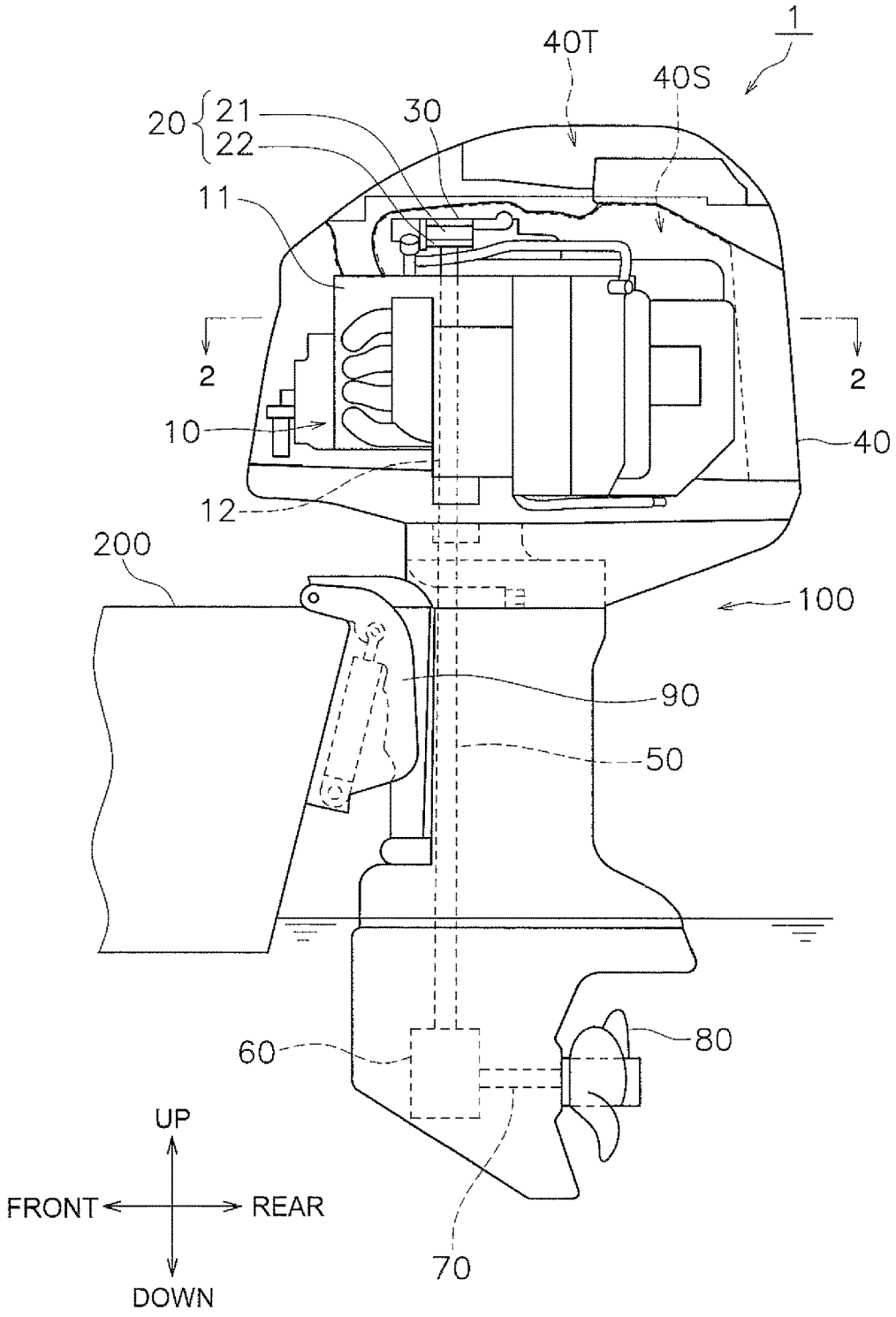
FIG. 1 is a side view of a watercraft according to a first preferred embodiment of the present invention.
Figure 2:
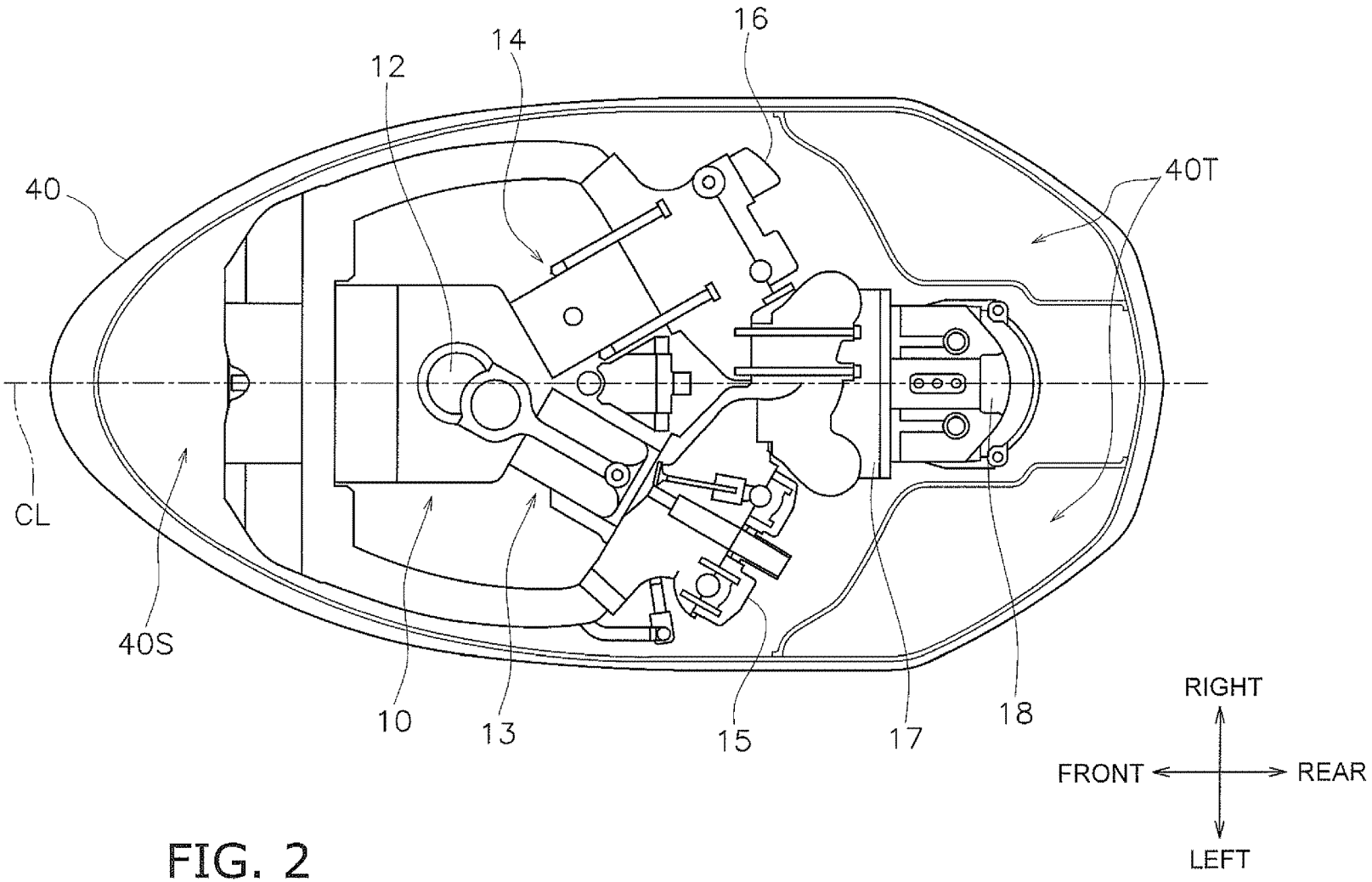
FIG. 2 is a cross-sectional view of FIG. 1 taken along line 2-2.

FIG. 1 is a side view of a watercraft 1 according to a first preferred embodiment of the present invention. As shown in FIG. 1, the watercraft 1 includes an outboard motor 100 and a hull 200. FIG. 2 is a cross-sectional view of FIG. 1 taken along line 2-2.

The outboard motor 100 is used as a propulsion device for the hull 200. The outboard motor 100 is attached to a rear end of the hull 200. The outboard motor 100 includes an engine 10, a flywheel type magnet generator 20, a fan 30, an engine cover 40, a drive shaft 50, a shift mechanism 60, a propeller shaft 70, a propeller 80, and a bracket 90.

The engine 10 is preferably a V-type eight-cylinder engine, for example, configured to burn fuel to generate a driving force. The engine 10 is accommodated in an engine compartment 40S provided within the engine cover 40.

The engine 10 includes a throttle body 11, a crankshaft 12, four first cylinders 13, four second cylinders 14, a first head cover 15, and a second head cover 16. The crankshaft 12 is disposed so as to extend in an up-and-down direction. The four first cylinders 13 overlap one above another, and obliquely extend rearward and leftward of the crankshaft 12. The four second cylinders 14 overlap one above another, and obliquely extend rearward and rightward of the crankshaft 12. Each of the first and second head covers 15 and 16 is one of the exterior portions of the engine 10. The first head cover 15 is disposed rearward and leftward of the four first cylinders 13. The second head cover 16 is disposed rearward and rightward of the four second cylinders 14. In the present preferred embodiment, "right" and "left" are terms defined with reference to a right-and-left center line CL (see FIG. 2) of the engine 10 that passes through the center of the crankshaft 12.

As shown in FIG. 2, an exhaust pipe 17 is connected to the engine 10. The exhaust pipe 17 encloses a catalyst 18. The exhaust pipe 17 is disposed in a middle of the outboard motor 100 in the right-and-left direction and extends in the up-and-down direction. The catalyst 18 is disposed between the four first cylinders 13 and the four second cylinders 14 in the right-and-left direction.

The flywheel type magnet generator 20 is preferably an AC generator as an auxiliary machine for the engine 10. The flywheel type magnet generator 20 includes a flywheel rotor 21 and a stator 22. The flywheel rotor 21 is attached to an upper end of the crankshaft 12. The stator 22 is disposed inside the engine 10 and the flywheel rotor 21. The stator 22 includes a plurality of cores and coils.

The fan 30 is disposed above the flywheel type magnet generator 20. The fan 30 is configured to suck air from below after the air passes through the flywheel type magnet generator 20 and also suck air inside the engine compartment 40S from above. The fan 30 is configured to discharge the air sucked therein.

The engine compartment 40S and an intake path 40T are provided in the interior of the engine cover 40. The engine compartment 40S is a space that accommodates the engine 10. The intake path 40T is a space that directs external air to the throttle body 11. The intake path 40T is located above and rearward of the engine compartment 40S. The construction of the engine cover 40 and that of the intake path 40T will be described below.

The drive shaft 50 is connected to a lower end of the crankshaft 12, and is configured to be rotated by the driving force of the engine 10. The shift mechanism 60 is configured to switch the rotation of the propeller shaft 70 into any of a forward moving state, a neutral state, and a rearward moving state. The propeller 80 is attached to a rear end of the propeller shaft 70. The bracket 90 connects the outboard motor 100 to the hull 200. The bracket 90 supports the outboard motor 100 so that it is pivotable back and forth and right and left.

Figure 3:
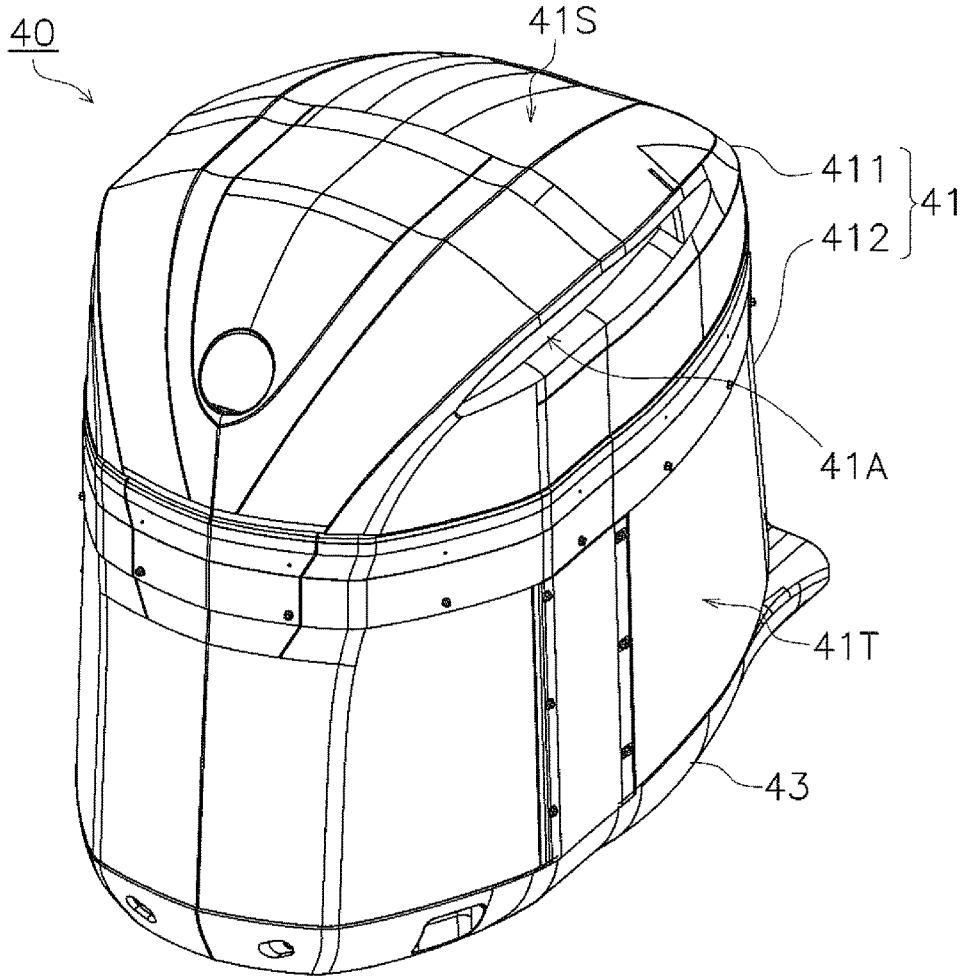
FIG. 3 is a rear perspective view of an engine cover according to the first preferred embodiment of the present invention.
Figure 4:
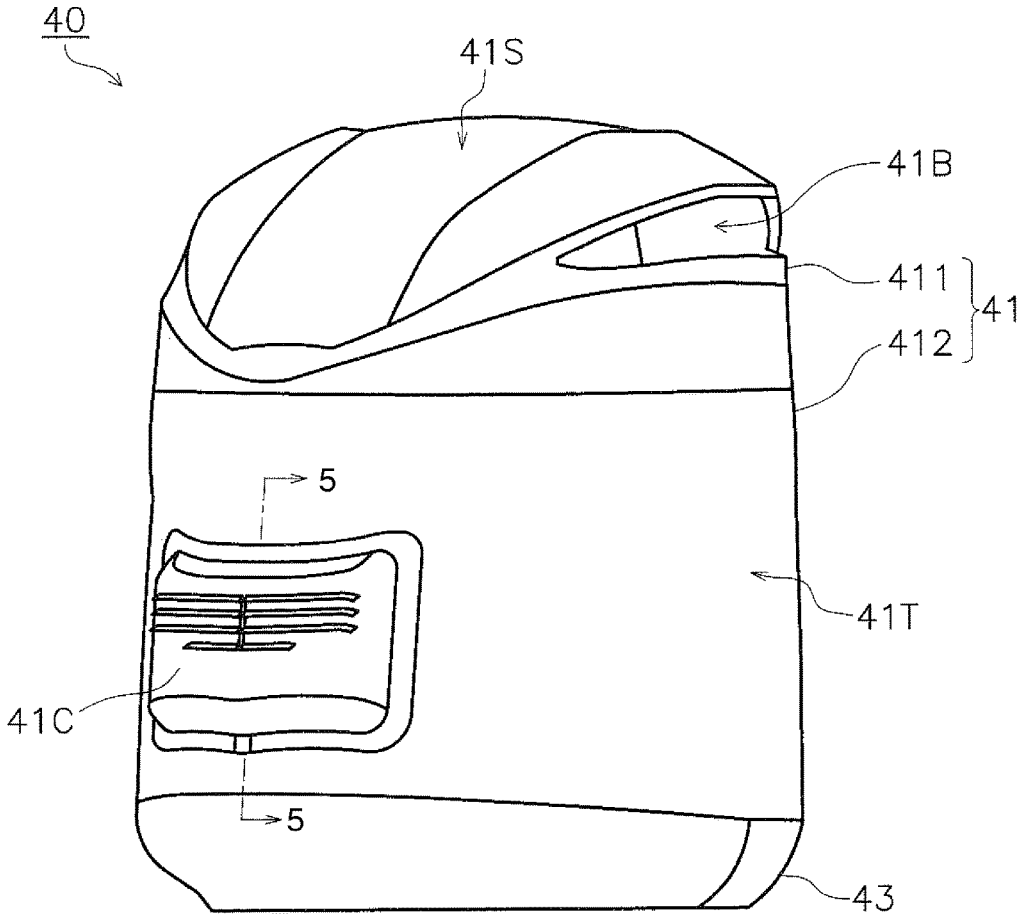
FIG. 4 is a front perspective view of the engine cover according to the first preferred embodiment of the present invention.
Figure 5:
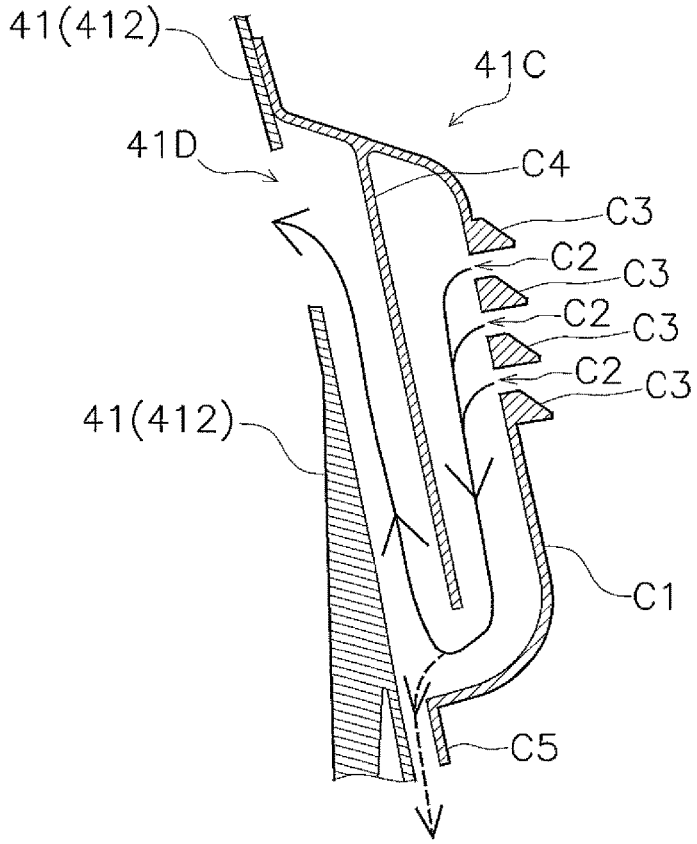
FIG. 5 is a cross-sectional view of FIG. 4 taken along line 5-5.
Figure 6:
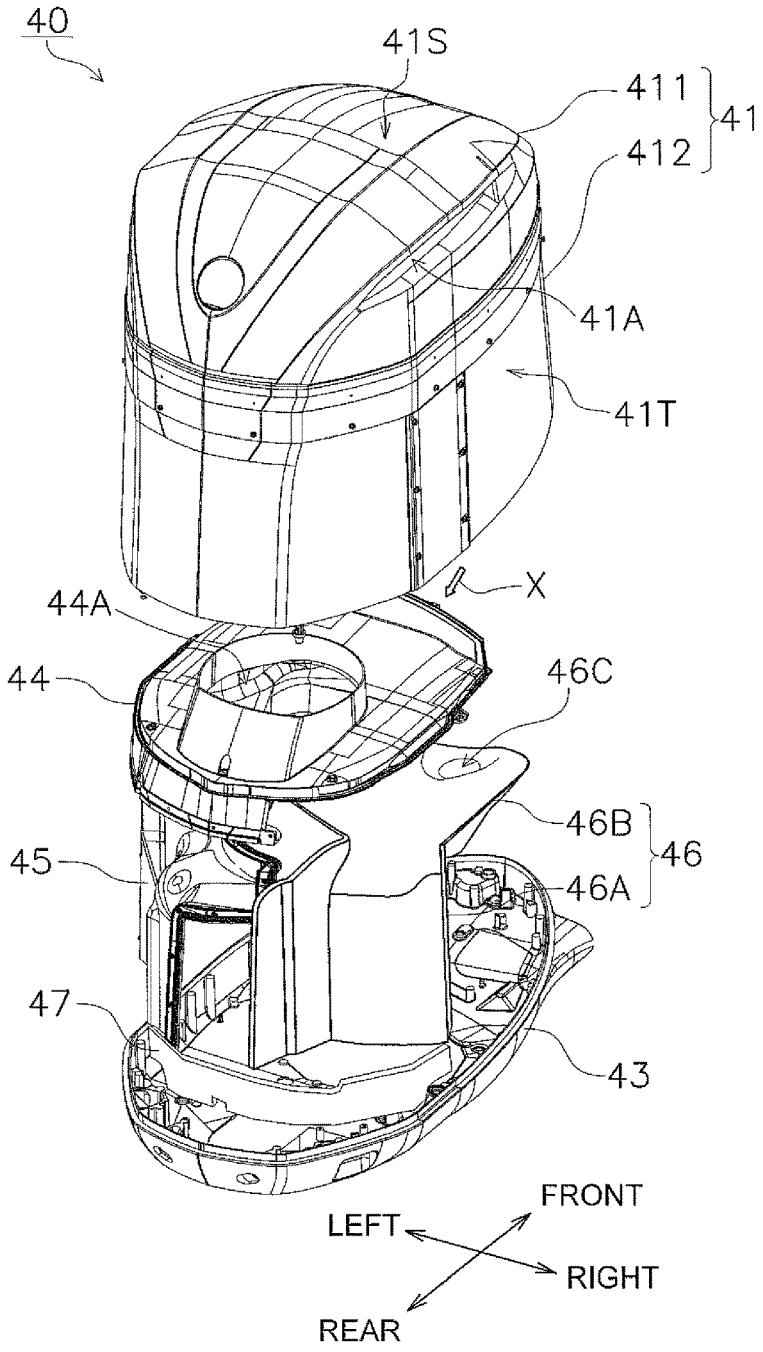
FIG. 6 is an exploded perspective view of the engine cover according to the first preferred embodiment of the present invention.
Figure 7:
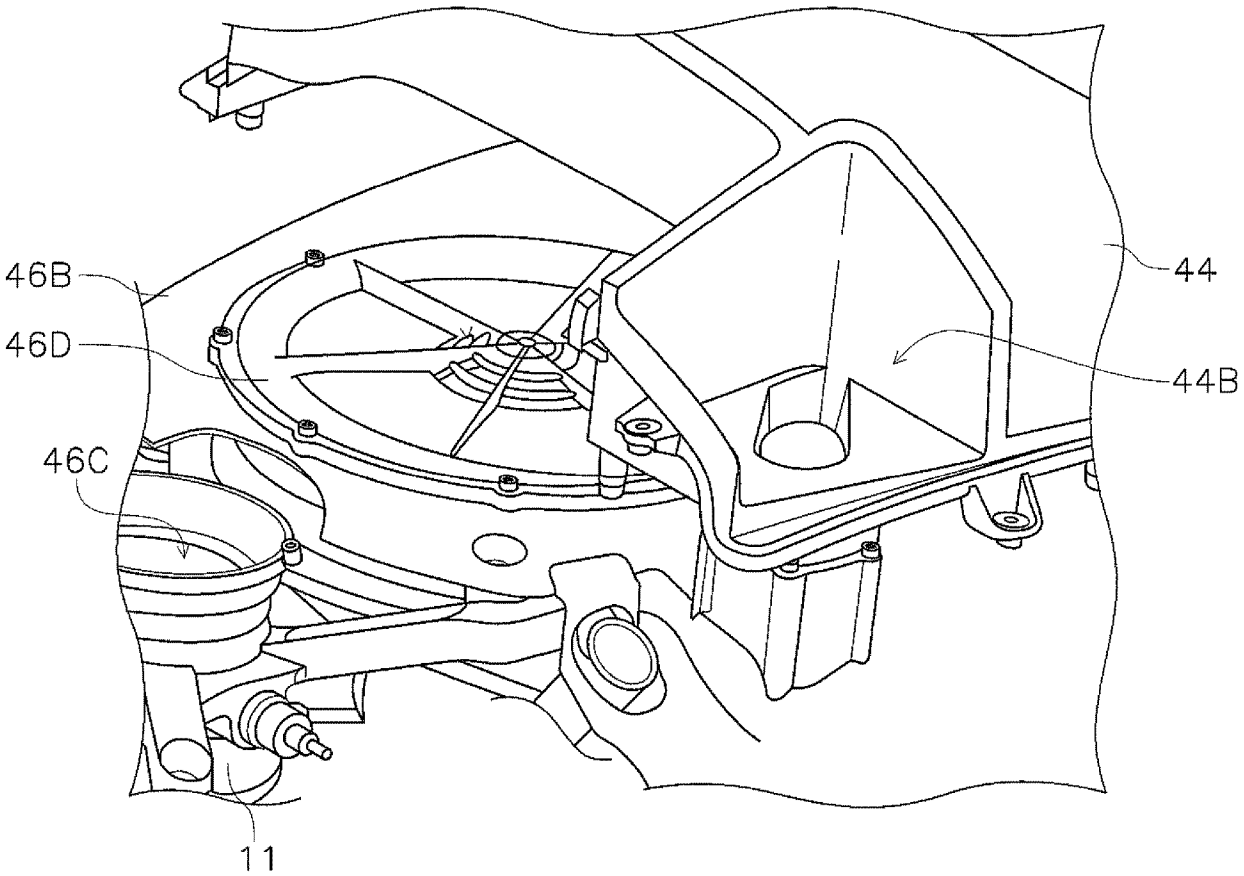
FIG. 7 is a view of FIG. 6 seen from a direction of arrow X.
Figure 8:
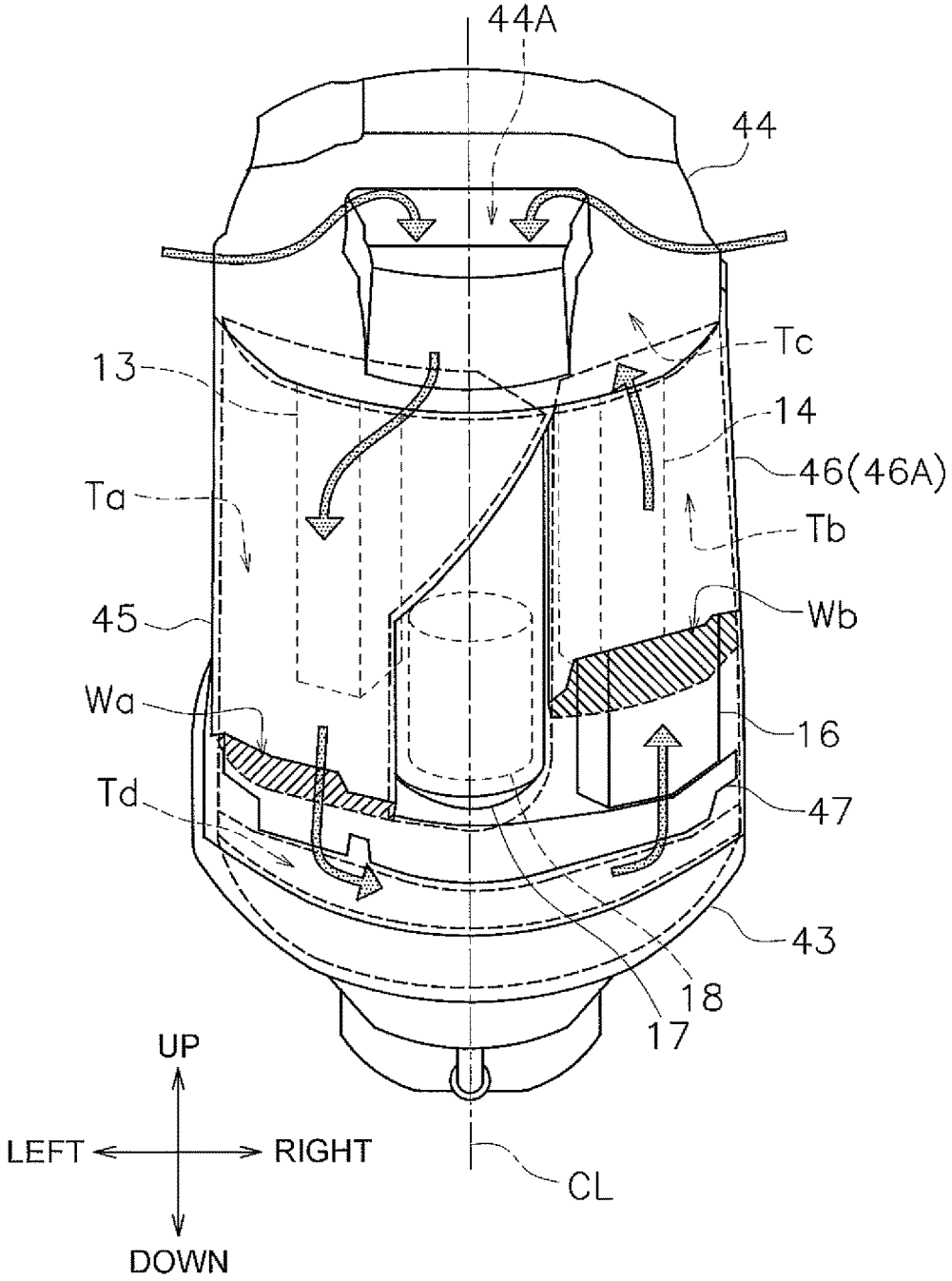
FIG. 8 is a schematic diagram of a construction of an intake path according to the first preferred embodiment of the present invention.
Figure 9:
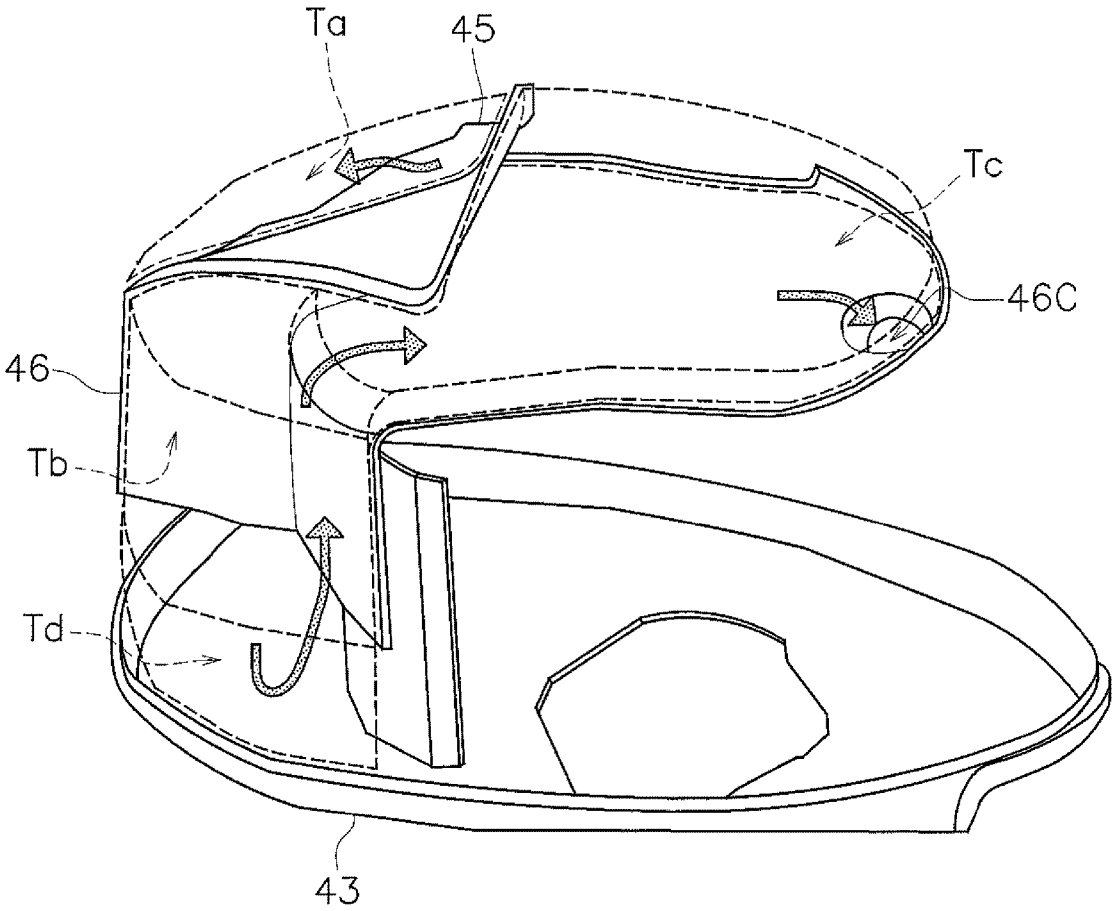
FIG. 9 is a schematic diagram of the construction of the intake path according to the first preferred embodiment of the present invention.

FIG. 3 is a rear perspective view of an appearance of the engine cover 40. FIG. 4 is a front perspective view of the appearance of the engine cover 40. FIG. 5 is a cross-sectional view of FIG. 4 taken along line 5-5. FIG. 6 is an exploded perspective view of the engine cover 40. FIG. 7 is a view of FIG. 6 as seen from a direction of arrow X. FIGS. 8 and 9 are schematic diagrams of the construction of the intake path 40T. It should be noted that an upper cover 41 is not shown in FIGS. 8 and 9 in order to explain the intake path 40T, and further, an inner lid 44 is also not shown in FIG. 9.

The engine cover 40 includes the upper cover 41, a lower cover 43, the inner lid 44, a first air duct member 45, a second air duct member 46, and a partition plate 47. The upper cover 41 includes an upper portion 411 and a lateral portion 412.

The intake path 40T includes a first airflow passage Ta, a second airflow passage Tb, a third airflow passage Tc, and an airflow space Td. The external air flows through the first airflow passage Ta, the airflow space Td, the second airflow passage Tb, the third airflow passage Tc, in this order, and is sucked into the engine 10.

The upper portion 411 is a lid-shaped exterior portion that covers the engine 10 from above. The upper portion 411 is disposed above the inner lid 44. The upper portion 411 preferably has a curved plate shape, and defines an upper surface 41S of the upper cover 41.

The lateral portion 412 is a tubular exterior portion that laterally encloses the engine 10. The lateral portion 412 is connected to the bottom of the upper portion 411. The lateral portion 412 defines a lateral surface 41T extending downwardly from the outer edge of the upper surface 41S. The lateral portion 412 includes a right opening 41A and a left opening 41B in the upper region thereof, and the right and left openings 41A and 41B are provided in the lateral surface 41T. The right and left openings 41A and 41B define and function as external air inlet ports to take in the external air to be introduced into the intake path 40T. As described below, the front end of the right opening 41A also functions as an outlet port to release the air discharged from the fan 30 (see FIG. 7).

The first and second air duct members 45 and 46 are attached inside the lateral portion 412. A space produced between the lateral portion 412 and the first air duct member 45 defines the first airflow passage Ta. Put differently, a portion of the first airflow passage Ta is defined by the lateral portion 412. The lower end (i.e., the exit) of the first airflow passage Ta is defined by the lower end of the first air duct member 45. The lower end of the first airflow passage Ta is preferably located adjacent to the lower cover 43. A space produced between the lateral portion 412 and the second air duct member 46 defines the second airflow passage Tb. A portion of the second airflow passage Tb is defined by the lateral portion 412. The lower end of the second airflow passage Tb (i.e., the entrance of the second airflow passage Tb) is defined by the lower end of the second air duct member 46.

A ventilation port cover 41C is attached to the front surface of the lateral portion 412. As shown in FIG. 5, the ventilation port cover 41C covers a ventilation port 41D provided in the lateral portion 412. The ventilation port 41D defines and functions as an external air inlet port to take in the external air into the engine compartment 40S (see FIG. 1). The ventilation port cover 41C includes a cover body C1, openings C2, louvers C3, a partition C4, and a drain C5. The cover body C1 preferably has a cup shape. The cover body C1 is preferably adhered to the lateral portion 412. The openings C2 are provided in the lateral surface of the cover body C1. The louvers C3 are provided on or attached to the lateral surface of the cover body C1 so as to protrude therefrom. The louvers C3 are disposed above the openings C2. The partition C4 is disposed inside the cover body C1. The upper end of the partition C4 is connected to the inner top surface of the cover body C1. The lower end of the partition C4 is spaced apart from the inner bottom surface of the cover body C1. A labyrinth flow path including a U-shaped cross-section is provided in the interior of the cover body C1 by the partition C4. The drain C5 is provided on the lower surface of the cover body C1 so as to protrude therefrom. Moisture is discharged to the outside through the drain C5 when the moisture and external air together enter into the cover body C1 through the openings C2.

The lower cover 43 is a lid-shaped exterior portion that covers the engine 10 from below. The lower cover 43 is connected to the bottom of the lateral portion 412. A space enclosed by the lower cover 43, the lateral portion 412, and the engine 10 defines the airflow space Td. The inner surface of the lower cover 43 and that of the lateral portion 412 define the airflow space Td of the intake path 40T. As shown in FIG. 8, the second head cover 16 is exposed between the partition plate 47 and the second air duct member 46. In the present preferred embodiment, the surface of the second head cover 16 also defines a portion of the airflow space Td.

The airflow space Td connects the first airflow passage Ta and the second airflow passage Tb, and directs the external air from the first airflow passage Ta to the second airflow passage Tb. As shown in FIG. 8, the airflow space Td extends rightward and leftward across a right-and-left center line CL of the engine 10. The airflow space Td is located below or rearward of the exhaust pipe 17. The airflow space Td directs the external air, which flows therein from the first airflow passage Ta, to the right toward the second airflow passage Tb.

Moisture, contained in the external air flowing into the airflow space Td from the first airflow passage Ta, is attached to the inner surface of the lower cover 43 when the external air hits the lower cover 43. Therefore, the lower cover 43 includes a water drainage hole (not shown in the drawings).

The inner lid 44 is disposed between the upper portion 411 and the lateral portion 412. As shown in FIG. 6, the inner lid 44 includes an inlet port 44A in the middle of the rear end thereof. When taken in through the right and left openings 41A and 41B of the upper cover 41 (specifically, the lateral portion 412), the external air flows from the inlet port 44A toward the first air duct member 45. As shown in FIG. 7, the inner lid 44 includes a discharge port 44B in the left portion of the front end thereof. The discharge port 44B releases the air discharged from the fan 30 to the outside. The discharge port 44B is located laterally inside the left opening 41B of the upper cover 41.

The first air duct member 45 is disposed between the inner lid 44 and the lower cover 43. The first air duct member 45 extends downwardly from a position under the inlet port 44A and simultaneously curves leftward. The space between the first air duct member 45 and the lateral portion 412 defines the first airflow passage Ta. The first airflow passage Ta downwardly directs the external air flowing therein through the inlet port 44A.

The second air duct member 46 is disposed under the inner lid 44. The second air duct member 46 includes a first portion 46A and a second portion 46B.

The first portion 46A is disposed on the right side of the first air duct member 45. The first portion 46A extends in the up-and-down direction. The lower end of the first portion 46A is located higher than the lower end of the first air duct member 45. A space between the first portion 46A and the lateral portion 412 defines the second airflow passage Tb. The second airflow passage Tb upwardly directs the external air flowing therein from the airflow space Td.

As shown in FIG. 8, with reference to the right-and-left center line CL of the engine 10, the first airflow passage Ta is disposed on the left side whereas the second airflow passage Tb is disposed on the right side. With reference to the catalyst 18 embedded in the exhaust pipe 17, the first airflow passage Ta is disposed on the left side whereas the second airflow passage Tb is disposed on the right side. The first airflow passage Ta is disposed rearward of the four first cylinders 13, whereas the second airflow passage Tb is disposed rearward of the four second cylinders 14.

The lower end of the first portion 46A is located higher than that of the first air duct member 45. Hence, the lower end of the second airflow passage Tb is located higher than the lower end of the first airflow passage Ta. The horizontal cross-sectional area Wb of the second airflow passage Tb is larger than the horizontal cross-sectional area Wa of the first airflow passage Ta. Therefore, the flow rate of the external air in the second airflow passage Tb is slower than that of the external air in the first airflow passage Ta.

The second portion 46B extends forwardly from the upper end of the first portion 46A. The second portion 46B includes an airflow port 46C provided in the front end thereof. The airflow port 46C is connected to the throttle body 11 of the engine 10. A cover member 46D is attached to the middle of the second portion 46B. The cover member 46D is disposed above the fan 30. A space between the second portion 46B and the inner lid 44 defines the third airflow passage Tc. The third airflow passage Tc extends to the upper end of the second airflow passage Tb. The third airflow passage Tc extends forwardly from the upper end of the second airflow passage Tb. The third airflow passage Tc forwardly directs the external air flowing therein from the second airflow passage Tb. When flowing forwardly through the third airflow passage Tc, the external air is sucked into the throttle body 11 through the airflow port 46C. The entrance of the third airflow passage Tc is defined by a boundary between the first portion 46A and the second portion 46B. The entrance of the third airflow passage Tc is located higher than the exit of the first airflow passage Ta in the up-and-down direction. The entrance of the third airflow passage Tc is located higher than the up-and-down directional middle of the engine 10. The entrance of the third airflow passage Tc is located higher a middle of the engine cover 40 in the up-and-down direction.

The partition plate 47 is fixed to the lower cover 43. The partition plate 47 is disposed under the first air duct member 45 and the second air duct member 46, and is also disposed between the engine 10 and the airflow space Td. In the present preferred embodiment, the surface of the partition plate 47 also defines a portion of the airflow space Td.

The intake path 40T according to the first preferred embodiment includes the first airflow passage Ta, the second airflow passage Tb, and the airflow space Td. The first airflow passage Ta is defined by the inner surface of the lateral portion 412, and downwardly directs the external air taken in through the right opening 41A and the left opening 41B (exemplary openings). The second airflow passage Tb is defined by the inner surface of the lateral portion 412, and upwardly directs the external air. The airflow space Td is provided above the lower cover 43, and directs the external air from the first airflow passage Ta to the second airflow passage Tb.

Thus, the intake path 40T is defined by the inner surface of the engine cover 40. It is therefore possible to widen the flow path compared to a construction in which an intake pipe is additionally mounted inside the engine cover 40. Consequently, the flow rate of the external air is inhibited, and thus, the efficiency of removing water drops contained in the external air is enhanced.

The first airflow passage Ta and the second airflow passage Tb are disposed rightward and leftward with respect to the right-and-left center line CL of the engine 10. The airflow space Td extends rightward and leftward with respect to the right-and-left center line CL.

Therefore, a long distance is provided from the lower end of the first airflow passage Ta to the lower end of the second airflow passage Tb in the space inside the engine cover 40. Thus, a smooth flow path is provided from the first airflow passage Ta to the second airflow passage Tb via the airflow space Td. As a result, the intake flow is smoothened.

The lower end of the second airflow passage Tb is located higher than that of the first airflow passage Ta. Therefore, the flow of the external air is smoothened from the airflow space Td to the second airflow passage Tb.

The horizontal cross-sectional area Wb of the second airflow passage Tb is larger than the horizontal cross-sectional area Wa of the first airflow passage Ta. Therefore, the efficiency of removing water drops is enhanced by increasing the flow rate of the external air in the first airflow passage Ta so as to cause the airstream containing water drops to hit against the lower cover 43 located under the lower end of the first airflow passage Ta. Simultaneously, the flow of the external air is smooth from the airflow space Td to the second airflow passage Tb.

The outboard motor 100 includes the partition plate 47 disposed between the airflow space Td and the engine 10. Therefore, high-temperature air, existing on the engine 10 side, is prevented from flowing into the airflow space Td. Hence, lower-temperature air is directed from the second airflow passage Tb to the throttle body 11.

The partition plate 47 is fixed to the lower cover 43. Therefore, unlike a construction in which the partition plate 47 is fixed to the first air duct member 45 and the second air duct member 46, it is not herein required to perform a clearance adjustment between the partition plate 47 and the lower cover 43.

The airflow space Td is partially defined by the second head cover 16 (an exemplary outer surface of the engine 10). Therefore, the number of components is reduced compared to a construction in which a partition is additionally mounted between the airflow space Td and the engine 10.

The first airflow passage Ta is disposed rearward of the four first cylinders 13, whereas the second airflow passage Tb is disposed rearward of the four second cylinders 14. Therefore, the intake path 40T is disposed rearward of the V-type engine that is reliably and easily designed to have a wide space in the right-and-left direction. Hence, the space inside the engine cover 40 is efficiently utilized.

The airflow space Td is located below or rearward of the exhaust pipe 17. Therefore, the airflow space Td extends to the right and left without being blocked by the exhaust pipe 17. Hence, the flow of the external air is smoothened in the intake path 40T.

The first airflow passage Ta and the second airflow passage Tb are disposed rightward and leftward with respect to the catalyst 18. Therefore, the intake path 40T is disposed in an irregular space located to the side of the catalyst 18. Hence, the space inside the engine cover 40 is efficiently utilized. Additionally, the interval between the first airflow passage Ta and the second airflow passage Tb is increased, and thus, the entire length of the intake path 40T is increased as much as possible. Hence, the flow of the external air is even further smoothened in the intake path 40T.

The engine cover 40 includes the ventilation port 41D. Therefore, generation of negative pressure is inhibited in the interior of the engine cover 40. Hence, the necessary adhesion is maintained between the upper cover 41 and the lower cover 43.

The entrance of the third airflow passage Tc is located higher than the up-and-down directional middle of the engine 10. By locating the entrance of the third airflow passage Tc in a high position, moisture climbing up the inner surface of the upper cover 41 is inhibited from intruding into the third airflow passage Tc.

The entrance of the third airflow passage Tc is located higher than the exit of the first airflow passage Ta in the up-and-down direction. By locating the entrance of the third airflow passage Tc spaced apart from the exit of the first airflow passage Ta, moisture discharged from the first airflow passage Ta is prevented from intruding into the third airflow passage Tc.

Second Preferred Embodiment

An outboard motor according to a second preferred embodiment of the present invention will be explained with reference to the attached drawings. The outboard motor according to the second preferred embodiment is different from the outboard motor 100 according to the first preferred embodiment regarding the construction of the third airflow passage of the intake path. The difference from the first preferred embodiment will be hereinafter explained.

Figure 10:
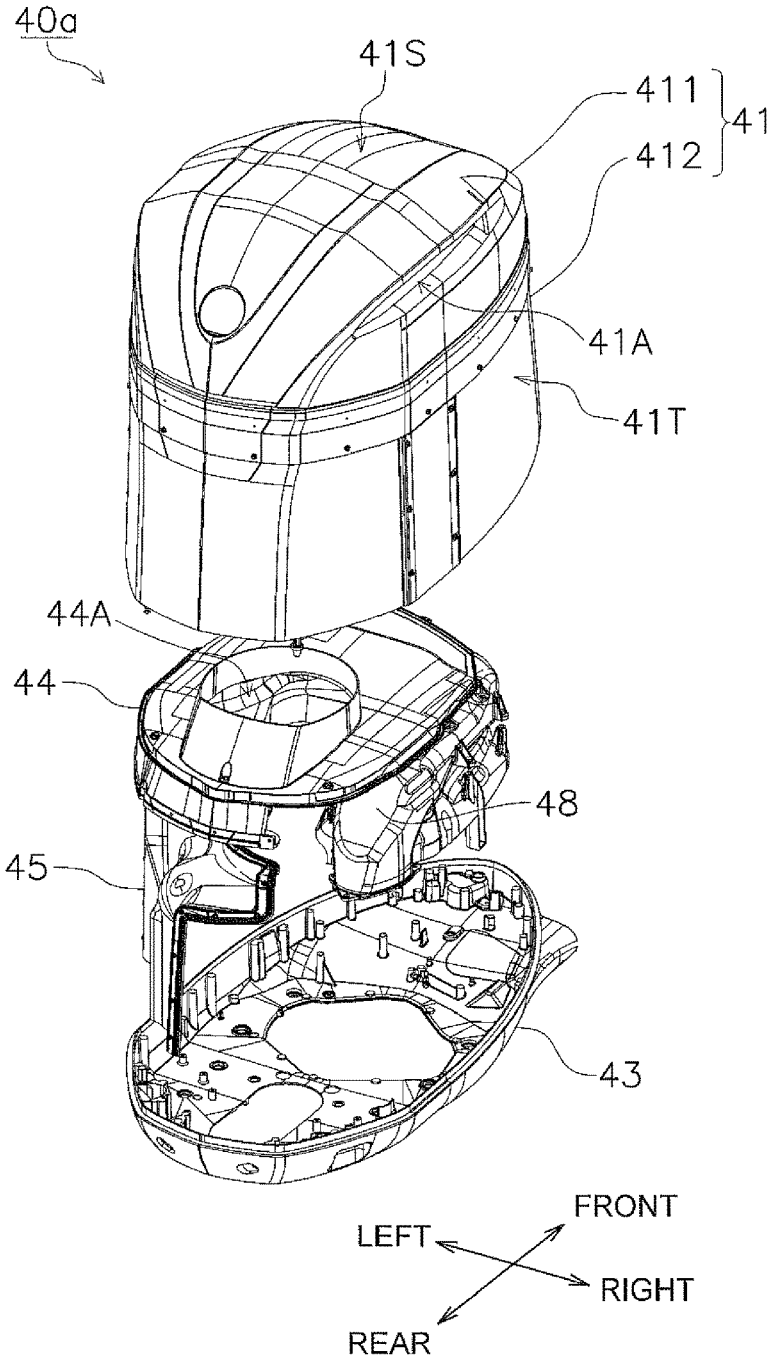
FIG. 10 is an exploded perspective view of an engine cover according to a second preferred embodiment of the present invention.
Figure 11:
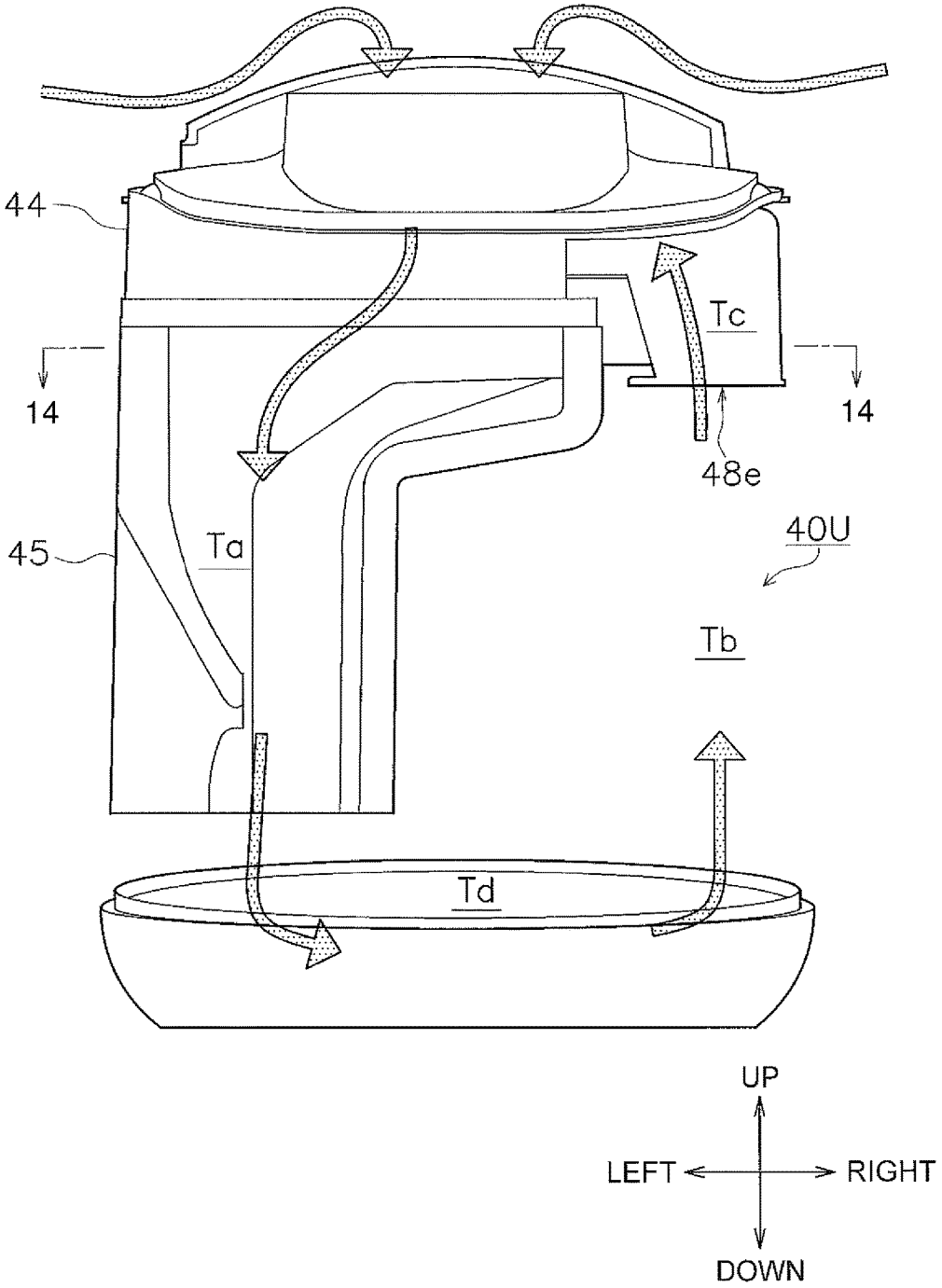
FIG. 11 is a schematic diagram of a construction of an intake path according to the second preferred embodiment of the present invention.

FIG. 10 is an exploded perspective view of the engine cover 40*a* according to the second preferred embodiment. FIG. 11 is a schematic diagram of the construction of an intake path 40U according to the second preferred embodiment. The engine 10 is not shown in FIG. 10, whereas the engine 10 and the upper cover 41 are not shown in FIG. 11.

As shown in FIG. 10, the engine cover 40*a* includes the upper cover 41, the lower cover 43, the inner lid 44, the first air duct member 45, and a hollow member 48. The upper cover 41, the lower cover 43, the inner lid 44, and the first air duct member 45 preferably have the same constructions as those explained in the first preferred embodiment.

As shown in FIG. 11, the intake path 40U includes the first airflow passage Ta, the second airflow passage Tb, the third airflow passage Tc, and the airflow space Td. The external air flows through the first airflow passage Ta, the airflow space Td, the second airflow passage Tb, and the third airflow passage Tc, in this order, and is sucked into the throttle body 11 (not shown in FIG. 11, see FIG. 7) of the engine 10. The first airflow passage Ta, the airflow space Td, and the second airflow passage Tb preferably have the same constructions as those explained in the first preferred embodiment.

The third airflow passage Tc includes the hollow member 48. The hollow member 48 extends in the back-and-forth direction. The hollow member 48 preferably includes a hollow space in the interior thereof. The hollow space inside the hollow member 48 is utilized as the third airflow passage Tc. The hollow member 48 is preferably a single, unitary component. The hollow member 48 preferably does not have joint surfaces on which plural components are joined to each other.

Figure 12:
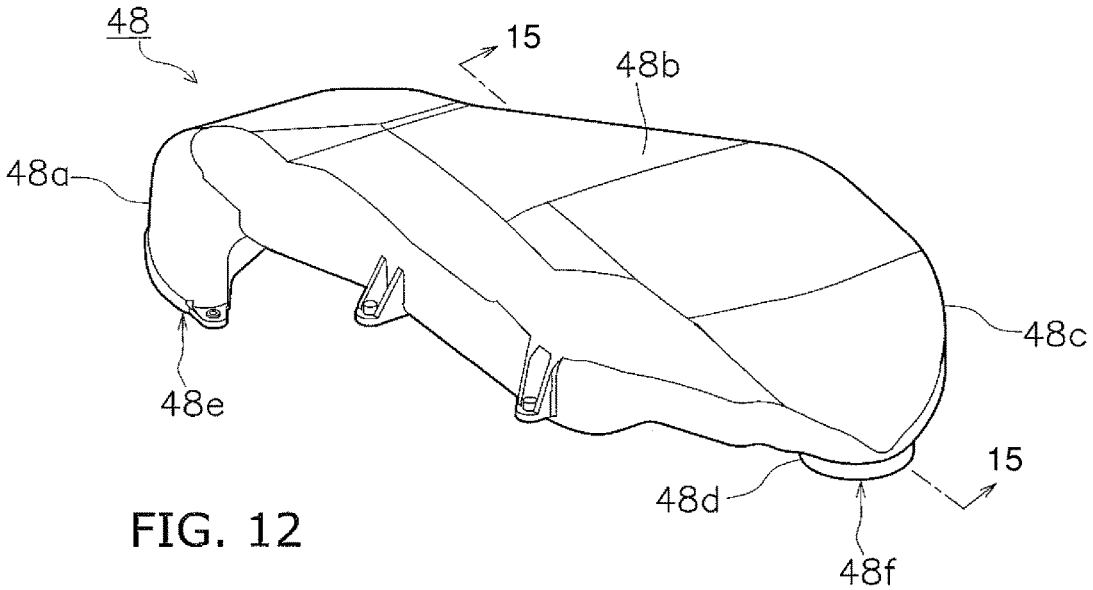
FIG. 12 is a front perspective view of a hollow member according to the second preferred embodiment of the present invention.
Figure 13:
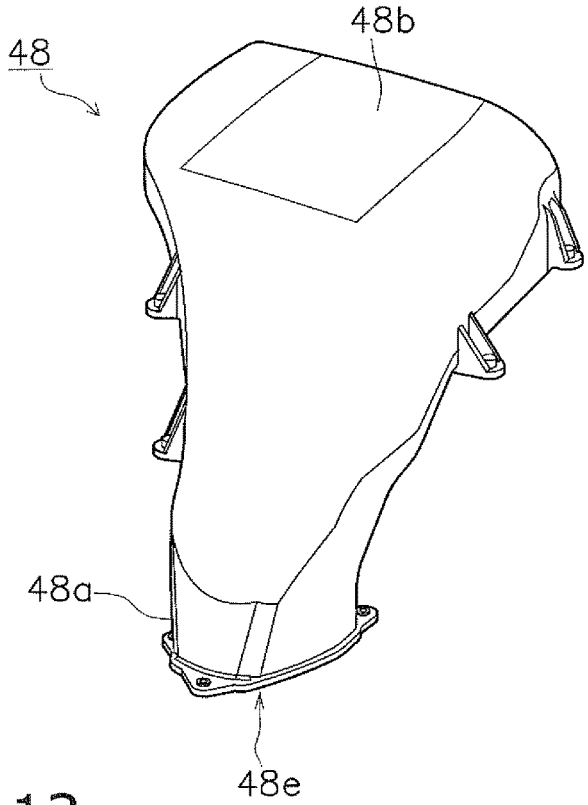
FIG. 13 is a rear perspective view of the hollow member according to the second preferred embodiment of the present invention.
Figure 14:
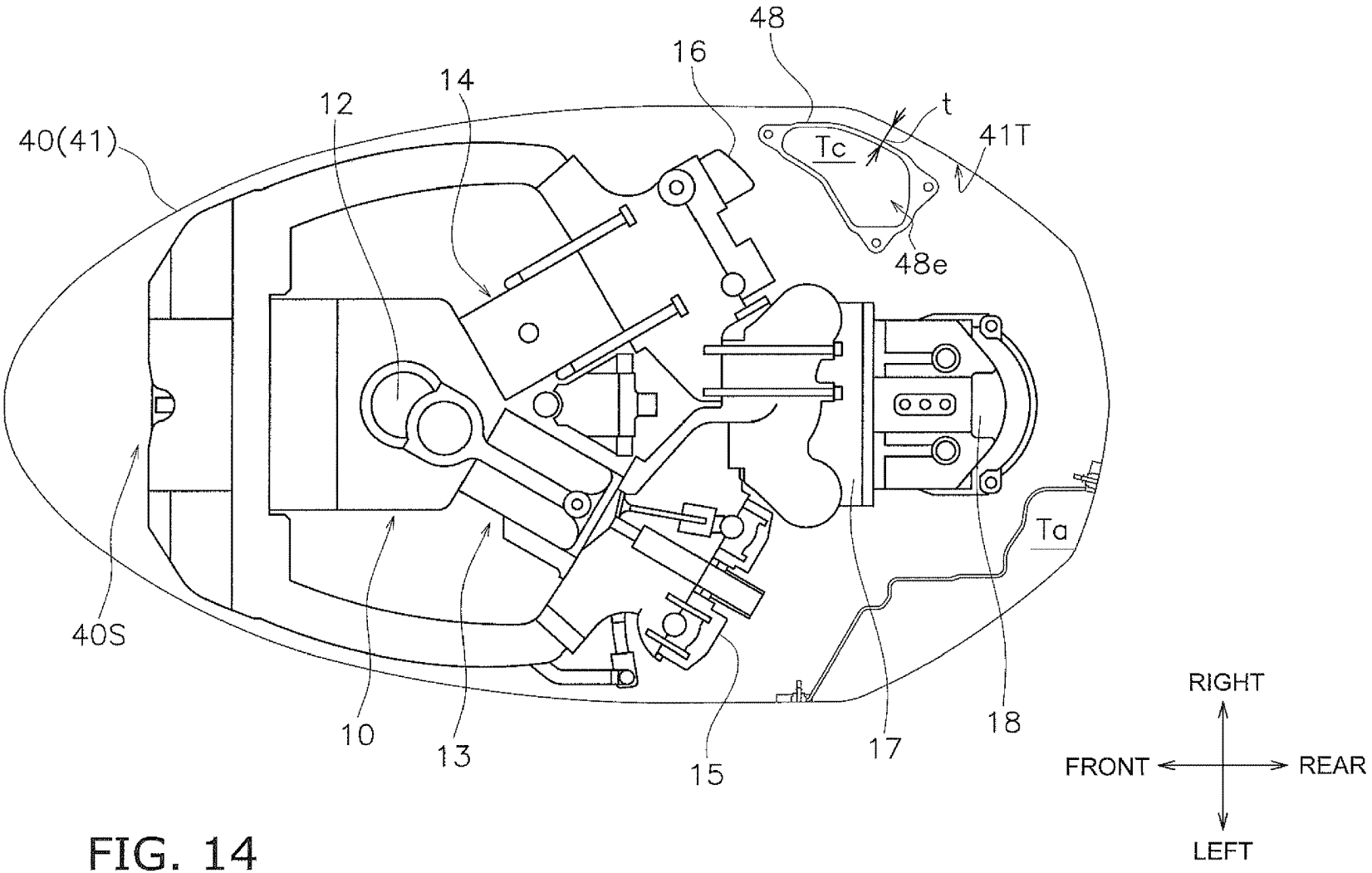
FIG. 14 is a cross-sectional view of FIG. 11 taken along line 14-14.
Figure 15:
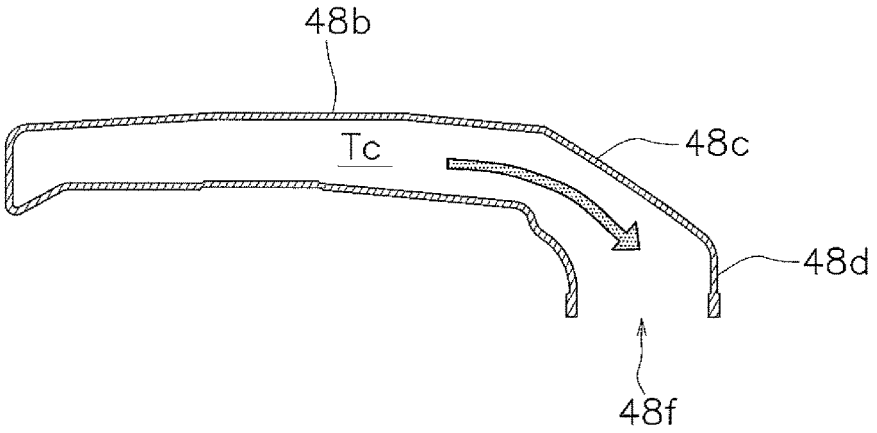
FIG. 15 is a cross-sectional view of FIG. 12 taken along line 15-15.

FIG. 12 is a front perspective view of the hollow member 48. FIG. 13 is a rear perspective view of the hollow member 48. FIG. 14 is a cross-sectional view of FIG. 11 taken along line 14-14. FIG. 15 is a cross-sectional view of FIG. 12 taken along line 15-15.

As shown in FIGS. 12 and 13, the hollow member 48 includes an entrance portion 48*a*, an enlarged diameter portion 48*b*, a constricted portion 48*c*, and an exit portion 48*d*.

The entrance portion 48*a* extends in the up-and-down direction. An entrance 48*e* is provided in the lower end of the entrance portion 48*a* so as to be opened downward. The entrance 48*e* is located above the second airflow passage Tb. As shown in FIG. 14, the entrance 48*e* is separated and spaced apart from an inner surface 41T of the upper cover 41. The interval (t) between the entrance 48*e* and the inner surface 41T is arbitrarily set as long as it enables moisture climbing up the inner surface 41T to pass therethrough. The entrance 48*e* is located higher than the exit of the first airflow passage Ta, i.e., the lower end of the first air duct member 45. The entrance 48*e* is located higher than a middle of the engine 10 in the up-and-down direction. The entrance 48*e* is also located higher than the middle of the engine cover 10*a* in the up-and-down direction. The external air, flowing into the entrance 48*e* from the second airflow passage Tb, flows upwardly through the entrance portion 48*a*.

The enlarged diameter portion 48*b* is joined to the upper end of the entrance portion 48*a*. The enlarged diameter portion 48*b* extends forwardly from the upper end of the entrance portion 48*a*. The width of the enlarged diameter portion 48*b* gradually increases as it extends forward. The inner radius of the enlarged diameter portion 48*b* gradually expands as it extends forward. The height of the enlarged diameter portion 48*b* is constant or substantially constant. When flowing into the enlarged diameter portion 48*b* through the entrance portion 48*a*, the external air flows forwardly and spreads in the right and left directions within the enlarged diameter portion 48*b*.

The constriction portion 48*c* is joined to the front end of the enlarged diameter portion 48*b*. As shown in FIG. 15, the constriction portion 48*c* extends forwardly from the front end of the enlarged diameter portion 48*b* and obliquely downward. The width of the constriction portion 48*c* gradually decreases as it extends forward. The inner diameter of the constriction portion 48*c* gradually decreases as it extends forward. The height of the constriction portion 48*c* is constant or substantially constant. When flowing into the constriction portion 48*c* from the enlarged diameter portion 48*b*, the external air flows forwardly obliquely downward and to the right and left directions within the constriction portion 48*c*. The enlarged diameter portion 48*b* and the exit portion 48*d* are smoothly joined through the constriction portion 48*c*, and thus, the external air is smoothly directed from the enlarged diameter portion 48*b* to the exit portion 48*d*. Consequently, pressure loss is reduced in the third airflow passage Tc.

The exit portion 48*d* is joined to the front end of the constriction portion 48*c*. The exit portion 48*d* extends downwardly from the front end of the constriction portion 48*c*. An exit 48*f* is provided in the lower end of the exit portion 48*d* so as to be opened downward. The lower end of the exit portion 48*d* is connected to the throttle body 11 of the engine 10. When flowing into the exit portion 48*d* from the constriction portion 48*c*, the external air flows downwardly through the exit portion 48*d* and is sucked into the throttle body 11 through the exit 48*f*.

The third airflow passage Tc according to the second preferred embodiment includes the hollow member 48 preferably made of a single, unitary component. Therefore, it is possible to prevent the occurrence of a situation that moisture intrudes into the third airflow passage Tc through other portions excluding the entrance 48*e* (e.g., a joint surface between the second air duct member 46 and the upper cover 41 in the first preferred embodiment) due to negative pressure generated in the third airflow passage Tc.

The entrance 48*e* of the hollow member 48 is separated and spaced apart from the inner surface 41T of the upper cover 41. Therefore, moisture climbing up the inner surface 41T is prevented from intruding into the third airflow passage Tc through the entrance 48*e*.

Other Preferred Embodiments

The present invention has been described with respect to the above preferred embodiments. However, it should not be understood that description and drawings, forming a part of this original disclosure, are intended to limit the present invention. A variety of alternative preferred embodiments, practical examples and operational techniques would be apparent for those skilled in the art from this disclosure.

In the above first and second preferred embodiments, the upper portion 411 and the lateral portion 412 are preferably integral and unitary. However, the upper portion 411 and the lateral portion 412 may be separate members.

Figure 16:
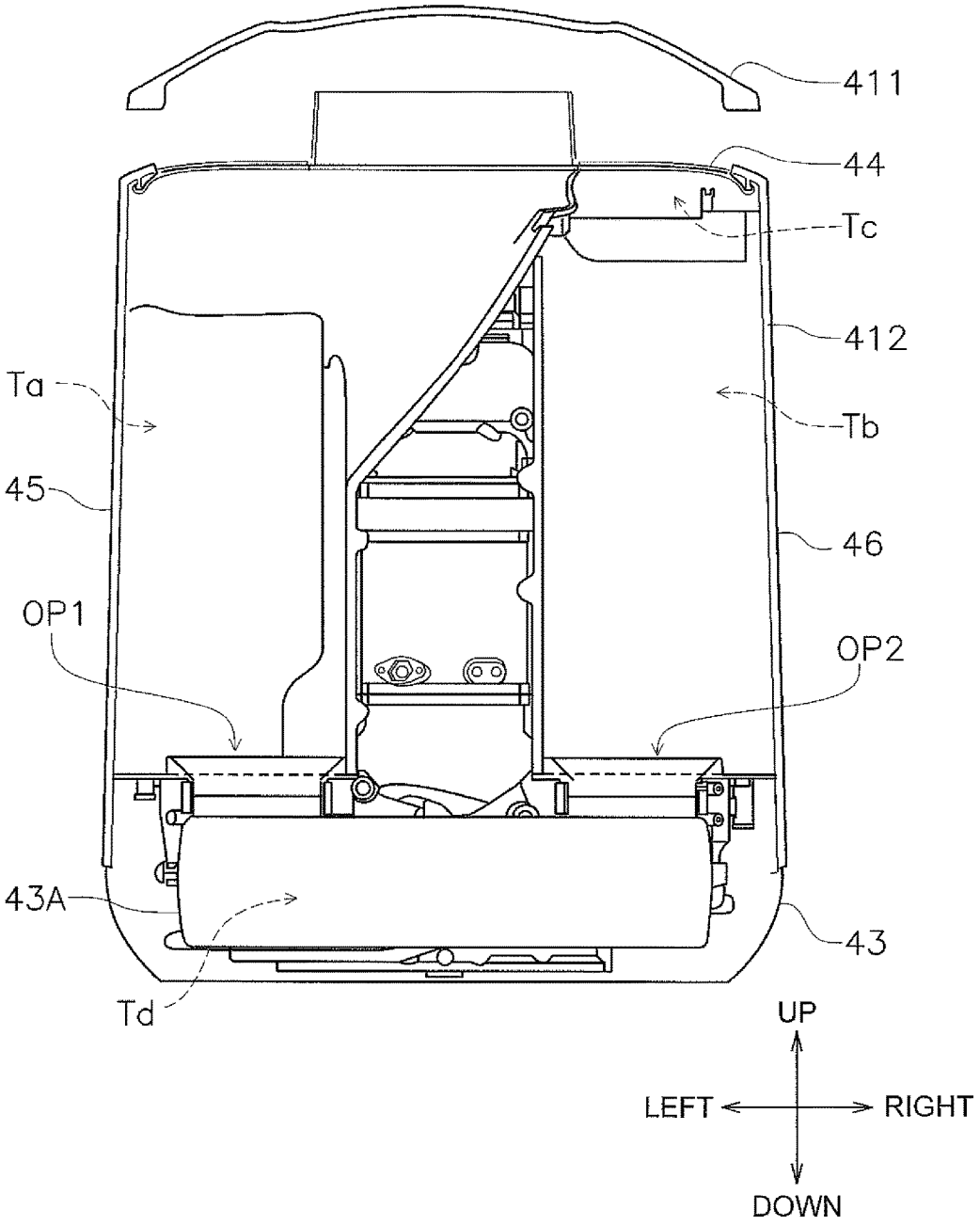
FIG. 16 is a schematic diagram of a construction of an intake path according to another preferred embodiment of the present invention.

In the above first and second preferred embodiments, the airflow space Td is preferably defined by the inner surface of the lower cover 43. However, the construction of the airflow space Td is not limited to the above. The airflow space Td is only required to be provided above the lower cover 43. For example, as shown in FIG. 16, the airflow space Td may be provided in the interior of an airflow pipe 43A. The airflow pipe 43A is disposed along the right-and-left direction. The airflow pipe 43A includes a first opening OP1 and a second opening OP2. The first opening OP1 opens in the lower end of the first airflow passage Ta, whereas the second opening OP2 opens in the lower end of the second airflow passage Tb. With the use of the airflow pipe 43A described above, it is similarly possible for the airflow space Td to direct the external air from the first airflow passage Ta to the second airflow passage Tb.

In the first and second preferred embodiments, the engine 10 is preferably a V-type eight-cylinder engine, for example. However, the construction of the engine 10 is not limited to the above. The engine 10 may be an inline engine, a parallel engine or so forth, and additionally, an arbitrary number of cylinders may be selected.

In the above first and second preferred embodiments, the first airflow passage Ta is preferably located in a left-side space within the engine cover 40, whereas the second airflow passage Tb is preferably located in a right-side space within the engine cover 40. Contrarily, the first airflow passage Ta may be located in the right-side space, whereas the second airflow passage Tb may be located in the left-side space.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

an engine cover accommodating the engine; and an intake path between the engine cover and the engine, the intake path configured to direct external air to the engine; wherein the engine cover includes an upper cover and a lower cover, the upper cover covering the engine from above and lateral sides of the engine, and the lower cover covering the engine from below;

the upper cover includes an opening configured to take in the external air into the intake path, and the opening is provided in an upper portion of the upper cover; and the intake path includes:

a first airflow passage at least partially defined by an inner surface of the engine cover, and the first airflow passage is configured to downwardly direct the external air taken in through the opening;

a second airflow passage at least partially defined by the inner surface of the engine cover, and the second airflow passage is configured to upwardly direct the external air; and an airflow space located above the lower cover and extending to the first airflow passage and the second airflow passage, and the airflow space is configured to direct the external air from the first airflow passage to the second airflow passage.

2. The outboard motor according to claim 1, wherein the first airflow passage is disposed on a first side with respect to a right-and-left center line of the engine;

the second airflow passage is disposed on a second side, opposite to the first side, with respect to the right-and-left center line of the engine; and the airflow space extends rightward and leftward with respect to the right-and-left center line.

3. The outboard motor according to claim 1, wherein a lower end of the second airflow passage is located higher than a lower end of the first airflow passage.

4. The outboard motor according to claim 1, wherein the second airflow passage has a horizontal cross-sectional area larger than a horizontal cross-sectional area of the first airflow passage.

5. The outboard motor according to claim 1, further comprising a partition plate disposed between the airflow space and the engine.

6. The outboard motor according to claim 5, wherein the partition plate is fixed to the lower cover.

7. The outboard motor according to claim 1, wherein the airflow space is at least partially defined by an outer surface of the engine.

8. The outboard motor according to claim 1, wherein the engine is a V-shaped engine including a crankshaft, a first cylinder, and a second cylinder, the crankshaft extending in an up-and-down direction, the first cylinder extending obliquely rearward from the crankshaft, and the second cylinder extending obliquely rearward from the crankshaft;

the first cylinder is disposed symmetrically to the second cylinder with respect to a right-and-left center line of the engine;

the first airflow passage is located rearward of the first cylinder; and the second airflow passage is located rearward of the second cylinder.

9. The outboard motor according to claim 8, further comprising an exhaust pipe disposed between the first cylinder and the second cylinder; wherein the exhaust pipe extends in the up-and-down direction; and the airflow space is located either below or rearward of the exhaust pipe.

10. The outboard motor according to claim 9, wherein the exhaust pipe includes a catalyst disposed between the first cylinder and the second cylinder; and the first airflow passage and the second airflow passage are disposed rightward and leftward with respect to the catalyst.

11. The outboard motor according to claim 1, wherein the engine cover includes a ventilation port.

12. The outboard motor according to claim 1, wherein the intake path includes a third airflow passage;

the third airflow passage extends forwardly from an upper end of the second airflow passage; and the third airflow passage is configured to direct the external air from the second airflow passage to the engine.

13. The outboard motor according to claim 12, wherein an entrance of the third airflow passage is located higher than a middle of the engine in an up-and-down direction.

14. The outboard motor according to claim 12, wherein the entrance of the third airflow passage is located higher than a lower end of the first airflow passage in the up-and-down direction.

15. The outboard motor according to claim 12, wherein the third airflow passage is defined by a hollow member made of a single, unitary component.

16. A watercraft comprising:

a hull; and the outboard motor recited in claim 1, the outboard motor being attached to the hull.

* * * * *